United States Patent [19]

Schirrmeister et al.

[11] 4,073,487

[45] Feb. 14, 1978

[54] DISCHARGING AND STACKING DEVICE FOR FLAT ARTICLES

[75] Inventors: Harry Schirrmeister, Tegernseen Landstrasse 185; Markus Haberstroh, Euckenstrasse 21, both of Munich, Germany

[73] Assignee: G.A.O. Gesellschaft fur Automation und Organisation mbH, Germany

[21] Appl. No.: 634,029

[22] Filed: Nov. 21, 1975

[30] Foreign Application Priority Data

Dec. 23, 1974 Austria ..... 10263/74

[51] Int. Cl.[2] ..... B65H 29/12; B65H 29/24; B65H 29/54; B65H 29/58

[52] U.S. Cl. ..... 271/64; 271/69; 271/80; 271/184; 271/196; 271/224

[58] Field of Search ..... 271/64, 65, 69, 80, 271/184–187, 194–196, 219, 224

[56] References Cited

U.S. PATENT DOCUMENTS

| | | | |
|---|---|---|---|
| 2,759,543 | 8/1956 | Conti | 271/194 X |
| 2,867,438 | 1/1959 | Hori | 271/199 X |
| 3,046,008 | 7/1962 | Velvel | 271/186 |
| 3,197,200 | 7/1965 | Burt | 271/64 X |
| 3,912,255 | 10/1975 | McInerny | 271/80 |

*Primary Examiner*—Robert W. Saifer

*Attorney, Agent, or Firm*—McGlew and Tuttle

[57] ABSTRACT

The device is of the type having a stacking drum with openings in its cylindrical periphery by means of which the articles to be conveyed can be adhered by suction to the drum and accumulated in an orderly stack, with the suction air being effective only within a predetermined circumferential range of the stacking drum. The stacking drum is so arranged in the conveying system that the articles to be conveyed are fed tangentially to the drum, and the stacking drum has only a single row of openings in its circumference, with the row extending parallel to the axis of the drum. The openings may be selectively connected either to vacuum or to a source of air under pressure so that, with suction being effective in the openings, the articles are grasped by the stacking drum at the leading edge, discharged around the stacking drum and fed to the stack while, with compressed air being supplied to the openings, the articles pass by the stacking drum and move on to a following conveying system. A blowing nozzle is provided to divert the trailing portions of the articles away from the drum, and the drum may be rotated either continuously or intermittently depending on whether the articles are fed to the drum either continuously or intermittently. The drum is in the form of a rotor surrounding a non-rotatable stator acting as a rotary air valve.

8 Claims, 7 Drawing Figures

DISCHARGING AND STACKING DEVICE FOR FLAT ARTICLES

FIELD AND BACKGROUND OF THE INVENTION

The present invention relates to a discharging and stacking device for flat articles to be conveyed, such as sheets of paper, documents, and the like.

In the conventional document-stacking devices, the stacking of very thin and limp documents frequently presents considerable difficulties, particularly if the conditions of the documents are very different, as is the case with used documents, for example.

German Printed Application 1,247,711, for example, proposes a stacking device which appears to be usable for these purposes. In that device, the documents to be stacked are discharged from the conveying system by means of a diverter and fed to a receiving drum having intakes which cause the documents to be sucked up. Before being stacked, the documents are separated from the receiving drum by belts, and braked by a pneumatic device. The structure of this stacking device permits energy-saving operation as a result of the intermittently operating pneumatic braking device, but requires a relatively large amount of mechanical apparatus. Furthermore, the stacking of very limp documents poses problems because, on the one hand, the trailing edge of a stacked document may at any time come into contact with the newly arriving documents or with the receiving drum, so the possibility of damage to the documents can not be excluded, and, on the other hand, the belt which separates the documents from the receiving drum constantly rubs on the last stacked document along a large surface, which also involves the risk of the document being crumpled or damaged.

SUMMARY OF THE INVENTION;

It is therefore the object of the invention to provide a device for discharging and stacking flat articles to be conveyed, particularly documents, which, without complicated discharge and diverter arrangements and in spite of a simple structure, ensures that even very limp documents are safely stacked without being damaged.

The invention therefore relates to a discharging and stacking device for flat articles to be conveyed, such as sheets of paper, documents, and the like, which dispenses with diverters and includes a stacking drum having openings with the aid of which the articles to be conveyed can be sucked up and accumulated in an orderly stack, with the intake air being effective only within a predetermined angular range of the stacking drum.

The invention is characterized in that the stacking drum is so disposed in the conveying system that the articles to be conveyed are brought up to it tangentially, that the stacking drum has only a single row of openings arranged along its circumference and extending parallel to its axis, that there are provided means for selectively causing intake air or compressed air to become effective at the openings, and that, with intake air being effective, the delivered articles to be conveyed are grasped by the stacking drum at the leading edge, discharged around said stacking drum, and fed to the stack, while, with compressed air being effective, the articles to be conveyed are allowed to pass by the stacking drum and move on to the subsequent conveying system.

The invention has a number of significant advantages. For example, since the documents are received directly from the conveying system, a separate discharging device and a diverter are rendered unnecessary for each stacking device. This proves to be especially cost-saving, particularly in sorting installations where a large number of stacking devices is arranged in series. The reduced amount of mechanical apparatus also permits a more compact design. Furthermore, no damage to the articles to be stacked is to be expected because the stacked documents rest against the stacking drum with the leading edge only, i.e. with a relatively small surface and little pressure, and because the frictional resistance between metal and paper is relatively low. Since the documents adhere relatively firmly to the stacking drum when being withdrawn from the conveying system, this stacking device is suitable for use in any kind of conveying system. It is possible to stack horizontally, vertically, or obliquely delivered documents. The use of only a single row of openings facilitates the stacking process, as will be explained below. Further features of the invention will be apparent from the claims and from the following description of two embodiments, in which all details not necessary for an understanding of the invention have been omitted.

BRIEF DESCRIPTION OF THE DRAWINGS

In the accompanying drawings.

DESCRIPTION OF THE PREFERRED EMBODIMENTS

Figure 1:
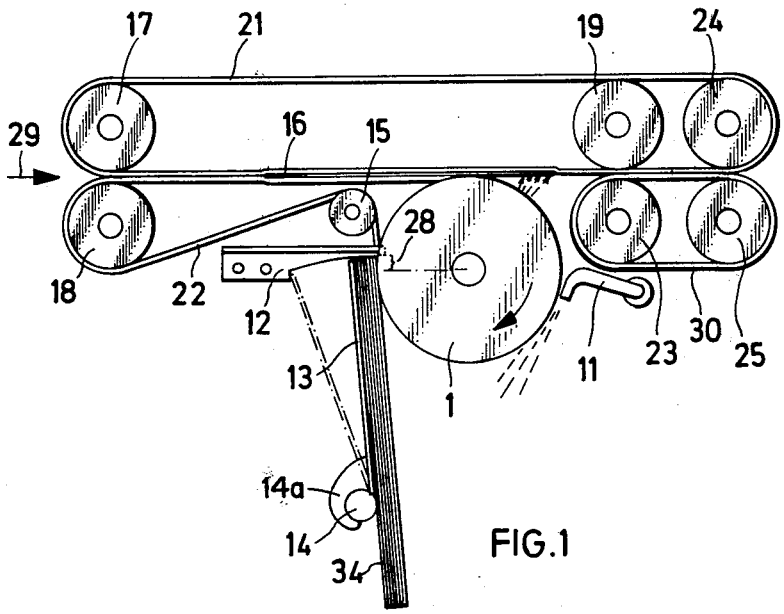
FIG. 1 is a device in accordance with the invention.
Figure 2:
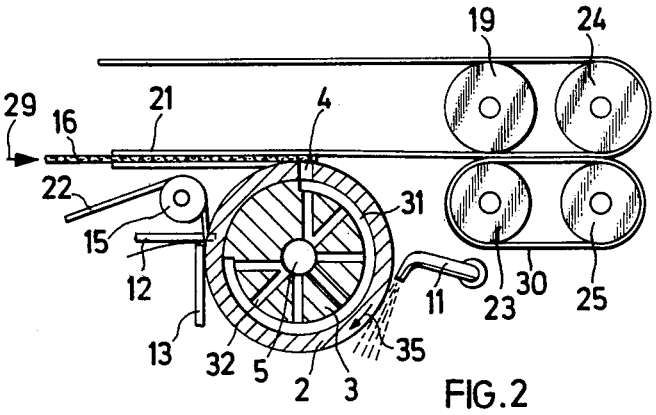
FIGS. 2 to 4 show different operating phases of the stacking drum.
Figure 3:
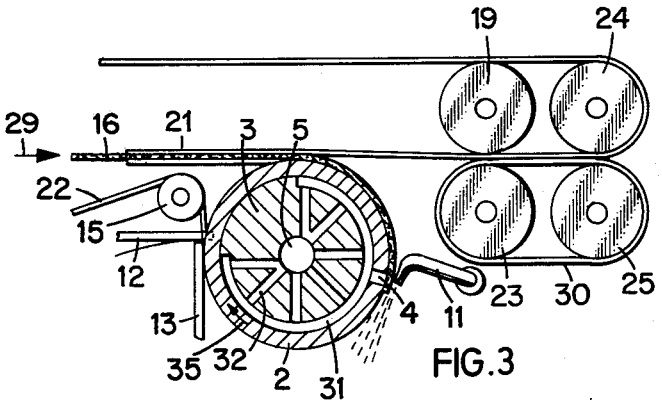
Figure 4:
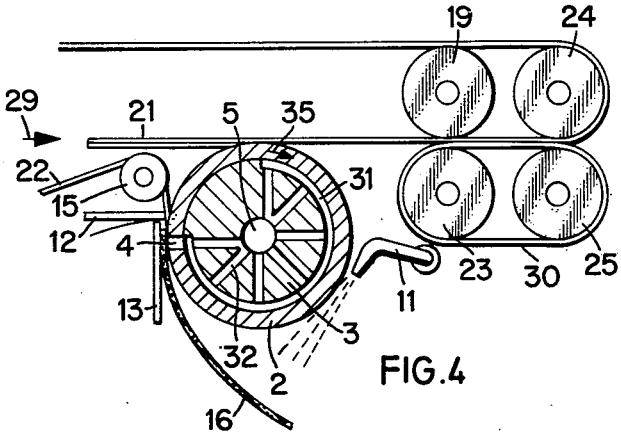

FIG. 1 shows a discharging and stacking device according to the invention, as can be integrated as a building block into an existing belt conveyor system. The drive rollers 17 and 18, overwhich run the respective conveyingbelts 21 and 22, form the entry to this building block, while the drive rollers 24 and 25, with the belt 21 and the belt 30, form the exit.

The documents 16 are delivered in the direction of the arrow 29 from a conveying system (not shown) running synchronously with the stacking device. With the drum 1 constantly rotating, the regular intervals between the individual documents is such that the leading edge of each document completely covers the intakes or vents 4 (FIGS. 2–5) arranged vertically above the other in the rotor 2. In the event that the documents 16 are delivered by the conveying system only intermittently, drum 1 also is driven intermittently in correspondence with the flow of the documents. The structure and operation of the stacking drum 1 will now be explained with the aid of FIGS. 2 to 5. As can be seen, the stacking drum 1 consists of a rotor 2 coupled directly to the drive system, and a stator 3 which performs the function of a rotary slide valve. The stator 3 is non-rotatably and fixedly mounted. It is connected with a control valve by means of which the openings 4 can be connected, in the range 31 through the connecting passages 32 and rotary slide valve passage 5, to a source of vacuum to supply intake air to the openings 4, intake air or to compressed air as required.

For carrying out a stacking operation, the stacking drum 1 is supplied with intake air. As soon as the openings 4 of the rotor 2 reach the range 31 of the stator 3, the document 16 covering the intakes 4 is sucked up by the prevailing vacuum and held by the rotor 2. The rotor 2, which rotates at a constant angular velocity in the direction of the arrow 35, pulls the document 16 by the leading edge in the direction of the stacking stop 12. The suction range 31 ends shortly before the document hits the stop 12, with the openings 4 being closed again by the rotary slide valve, and the document 16 being detached from the rotor 2 and stacked in an orderly stack 34 (FIG. 1). In the present case, a stacking arrangement perpendicular to the conveying system has been chosen for practical reasons. Therefore, the suction range 31, within which the document 16 adheres to the rotor 2, extends over an angular range of 270°. By reducing or enlarging this suction range, adaptation to other conditions can be achieved, but care should be taken that this range is not chosen to be too small.

To further improve the stacking, a blowing nozzle 11 is provided which is displaced about 90° from the direction of conveyance, indicated by the arrow 29, and by means of which an intermittent current of air is blown against the trailing edge of the document so that the latter is swung against the stack 34. The result is that the document 16 is really held by the leading edge only and can be very quickly released at any time following disconnection of the intakes. In addition, by the outward swing of the document, part of the document's energy is released, so that the document will crush only a little when the leading edge hits the stop. This additionally favors accurate stacking.

Figure 6:
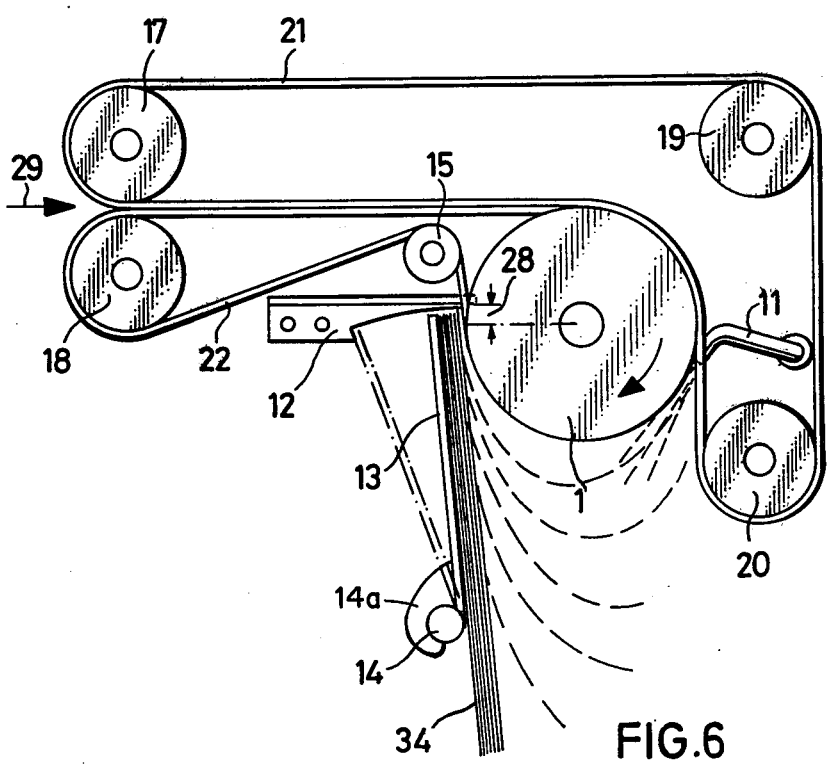
FIG. 6 shows an embodiment of the invention as a final stacking device.

The air current directed against the trailing edge of the documents is particularly advantageous in the embodiment of FIG. 6. When the trailing edge of the document 16 leaves the deflection range, which is supported by the conveying belts 21 and 22, there is the risk of the document remaining stuck to the rotor 2, thus hindering exact stacking. By the air current from the blowing nozzle 11, safe detachment of the document trailing edge from the rotor 2 and, consequently, good stacking are achieved.

After having been released, the documents, hitting the stop 12 with the leading edge, form the orderly stack 34, which is held in vertical position by the pressure plate 13 on one side and the rotor 2 on the other. Pressure plate 13 can be resiliently pressed into contact with stacking drum 1 by means of a spring 14*a*.

Depending on the thickness of the stack, that edge of the pressure plate 13 which is located at the stacking stop 12 swings outwardly around the pivot point 14 (FIG. 6).

The conveying-belt 22 is guided in the two grooves 27 of the stacking drum 1 in such a way that the belts do not project beyond the drum diameter. By contrast, the conveying belt 21 lies on the non-recessed areas of the rotor circumference. The stacking stop 12 engages with the groove 26 of the rotor 2. This ensures that none of the documents can slide through between the stacking stop 12 and the stacking drum 1. To ensure the fast and safe detachment of the document leading edge from the rotor 2, the deflection roller 15 may be positioned so that the conveying belt 22 leaves the guide grooves 27 in the area 28 and thus remove the document from the stacking drum 1 in a known manner. Since this detachment takes place only within a very narrow range of the leading edges, a sufficient distance is kept from the rotor, and the friction acting on the document is negligible.

Figure 5:
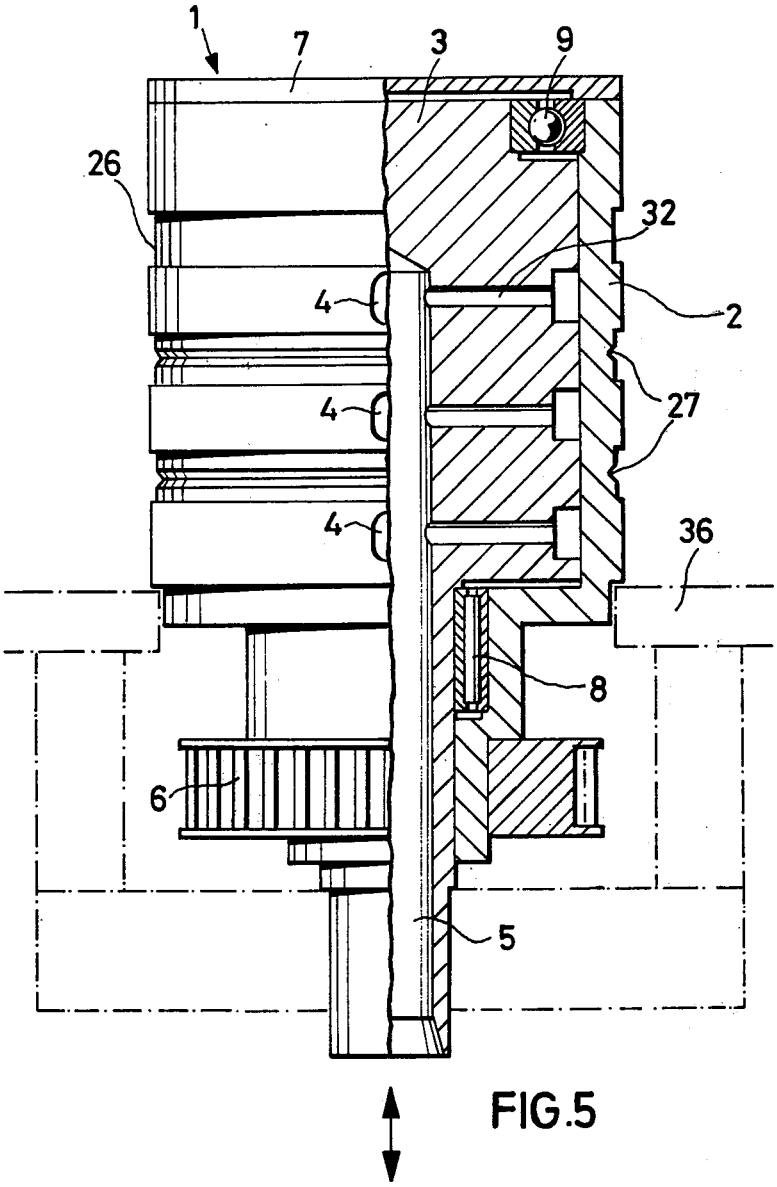
FIG. 5 shows the stacking drum in a half section.

As may be seen in FIG. 5, the rotary slide valve, which is covered with the cover 7, is firmly joined to the bottom plate 36 with a support indicated by broken lines. After a clamp has been eased, however, the rotary slide valve can be adjusted. The rotor 2 is mounted on the stator 3 by means of the needle bearing 8 and the ball bearing 9. It is driven via a toothed timing belt by the gear 6, which is positively connected with the rotor below the bottom plate.

If the delivered document is not to be stacked, i.e. discharged, compressed air instead of intake air will be generated in the stacking drum 1. The compressed air penetrates the holes of the row of holes 4 so that the document 16 will be urged against the conveying-belt 21, thus being passed on to the rollers 19 and 23. Via the rollers 24 and 25 the document 16 then moves into the subsequent conveying system (not shown).

Figure 7:
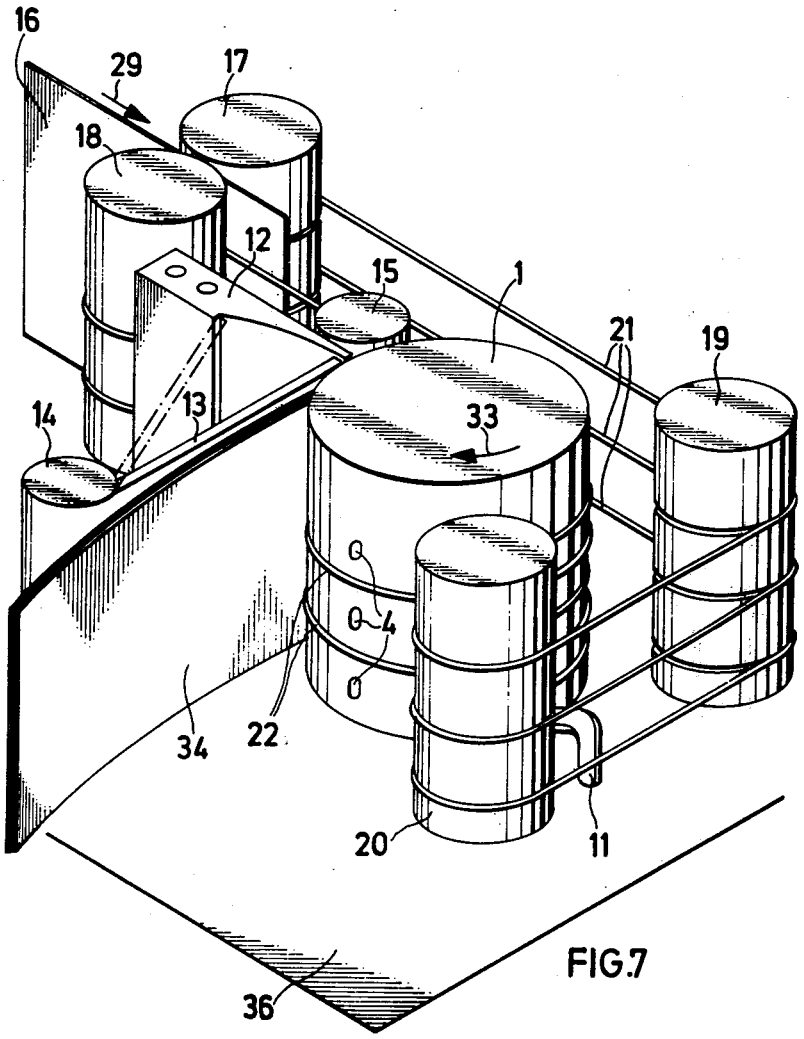
FIG. 7 is a three-dimensional representation of the embodiment of FIG. 6.

FIGS. 6 and 7 show an embodiment in which the novel device is used as the output device of a conveying system or as the final stacking device of several stacking devices arranged in series. The operation of the stacking drum 1 during the stacking of the documents is the same as described above with the aid of FIGS. 1 to 5, so it need not be explained here again. The only difference is that the conveying-belt system 30 with the drive rollers 23 and 25 is dispensed with, and that the drive roller 24 is replaced by the drive roller 20, which is so displaced that the conveying belt 21 contact the roller 29 along about one fourth of its circumference.

An additional advantage of this embodiment lies in the fact that, in the case of especially long documents whose trailing edge is still caught between the stacking drum 1 and the belts 21 while the leading edge has already arrived at the stacking stop 12, the detachment of the documents 16 from the stacking drum is assisted by the trailing edge being pushed by means of the conveying belts 21 and 22, which are deflected around the stacking drum 1.

The conveying arrangement of FIG. 6 is again shown in the three-dimensional representation of FIG. 7, which also shows the corresponding parts of FIG. 1. As can be seen, the drive rollers 17 and 18 form the entry to the stacking device, while the drive rollers 19 and 20, along with the stacking drum 1 rotating in the direction of the arrow 33, cause the documents 16 introduced into the stacking device to be stacked. The conveying-belt 22 is guided around the drive roller 18, the stacking drum 1, and the deflection roller 15, while the conveying-belt 21 runs over the drive rollers 17, 19, and 20 and over the stacking drum 1.

While specific embodiments of the invention have been shown and described in detail to illustrate the application of the principles of the invention, it will be understood that the invention may be embodied otherwise without departing from such principles.

What is claimed is:

1. In a discharging and stacking device for flat articles to be conveyed, such as sheets of paper and documents, of the type including a stacking drum having openings in its periphery by means of which the articles to be conveyed can be held by suction against the drum and accumulated in an orderly stack, with the suction being effective within only a predetermined angular range of rotation of the stacking drum, the improvement comprising, in combination, a conveying system operable to feed flat articles to said stacking drum; means mounting said stacking drum at a position, relative to said conveying system, such that the articles to be conveyed are fed tangentially to said stacking drum; said stacking drum being formed with a single row of openings in its circumferential periphery, with said single row of openings extending parallel to the axis of said stacking drum; stack supporting means, for the articles to be stacked, mounted adjacent said stacking drum; means operable selectively to connect said single row of openings to a source of vacuum, to supply intake air to said openings, or to a source of air under pressure, to supply pressure air for discharge through said openings; whereby, with suction being effective at said openings, the delivered articles to be conveyed are held, by their leading edges, against said stacking drum, discharged around said stacking drum and fed to said stack supporting means while, with air under pressure discharged through said openings, the articles to be conveyed are caused to pass by said stacking drum; and a following conveying system operable to receive articles passing by said stacking drum.

2. In a discharging and stacking device for flat articles, the improvement claimed in claim 1, in which said conveying system operable to feed flat articles to said stacking drum comprises a first endless conveying-belt guided around a pair of first drive rollers and a second endless conveying-belt guided around a second drive roller and around said stacking drum; said conveying system receiving articles passing by said stacking drum comprising a third endless conveying belt guided around a pair of third drive rollers and cooperating with said first endless conveying-belt.

3. In a discharging and stacking device for flat articles, the improvement claimed in claim 1, in which said stacking drum comprises a cylindrical rotor formed with said single row of openings therethrough; and a cylindrical stator rotatably supporting said rotor.

4. In a discharging and stacking device for flat articles, the improvement claimed in claim 3, in which said rotor is driven at a constant speed.

5. In a discharging and stacking device for flat articles, the improvement claimed in claim 1, including a blowing nozzle supplied with air under pressure and directing air under pressure tangentially to said stacking drum and toward said stack supporting means to move the trailing portions of the articles away from said stacking drum.

6. In a discharging and stacking device for flat articles, the improvement claimed in claim 1, in which said stack supporting means comprises a stacking stop displaced from the axis of symmetry of said stacking drum in the direction of rotation of said stacking drum.

7. In a discharging and stacking device for flat articles, the improvement claimed in claim 6, in which said stacking drum is formed with a circumferentially extending groove; one end of said stacking stop extending into said groove.

8. In a discharging and stacking device for flat articles, the improvement claimed in claim 1, in which said stack supporting means comprises a pressure plate arranged to have a stack of articles rest thereagainst; means pivotally supporting said pressure plate; and means resiliently biasing one end of said pressure plate toward said stacking drum.

* * * * *